United States Patent [19]

Wetmore

[11] 4,451,174

[45] May 29, 1984

[54] MONOPOD JACKUP DRILLING SYSTEM

[75] Inventor: Sherman B. Wetmore, Westminster, Calif.

[73] Assignee: Global Marine Inc., Los Angeles, Calif.

[21] Appl. No.: 464,481

[22] Filed: Feb. 7, 1983

[51] Int. Cl.[3] ..... E21B 15/02; E02B 17/02

[52] U.S. Cl. ..... 405/196; 405/203; 405/217

[58] Field of Search ..... 405/196–200, 405/203, 204, 207, 208, 224, 217; 254/105–112; 175/5–10; 114/264, 265

[56] References Cited

U.S. PATENT DOCUMENTS

| | | | |
|---|---|---|---|
| 2,841,961 | 7/1958 | Lucas | 405/199 |
| 3,433,024 | 3/1969 | Diamond et al. | 405/196 |
| 3,717,001 | 2/1973 | Tam | 405/224 X |
| 3,754,403 | 8/1973 | Mott et al. | 405/196 |
| 3,996,754 | 12/1976 | Lowery | 405/203 X |
| 4,065,934 | 1/1978 | Dysarz | 405/196 |
| 4,265,568 | 5/1981 | Herrmann et al. | 405/196 |

*Primary Examiner*—Dennis L. Taylor

*Attorney, Agent, or Firm*—Christie, Parker & Hale

[57] ABSTRACT

A mobile offshore platform has a buoyant and ballastable mat base of substantial horizontal extent. A cylindrical pylon is fixed to and extends upwardly from the center of the base. The pylon has a height greater than the maximum operating water depth of the platform. A positively buoyant deck unit has a central opening through it within which the pylon cooperates. The deck unit is movable vertically along the pylon in response to the operation of jacking mechanisms and cooperating jacking legs located adjacent the corners of the deck unit. The jacking legs are engageable at their lower ends with the base whereby operation of the jacking mechanism causes the deck unit to be moved vertically along the pylon relative to the base. In use, the deck unit is elevated to the top of the pylon after the base is submerged into contact with a sea floor and the jacking legs are thereafter disposed in a retracted position with their lower ends adjacent the deck unit. In use, the deck unit is disposed above the water surface. The platform is especially suited for use in ice-covered waters on the margins of the Arctic Ocean.

21 Claims, 15 Drawing Figures

10
12
13
14
15
47
49
52
70
71

80
81
82
83
61
13
14
15
12

MONOPOD JACKUP DRILLING SYSTEM

BACKGROUND OF THE INVENTION

1. Field of the Invention

This invention pertains to structural and procedural aspects of offshore platforms useful in Arctic waters on a year-round basis as well as in less severe environments. More particularly, it pertains to a floatable gravity-type jackup offshore platform structure having a deck unit which is jackable relative to a mat-type base along jacking legs carried by the deck unit and engageable with the base, the legs being retractible to the deck unit after connection of the elevated deck unit to a supporting pylon which is carried by the base and which extends through a central opening in the deck unit.

2. Review of the Prior Art and the Need Presented

The seas, bays and inlets on the margins of the Arctic Ocean, outside the realm of the permanent North Polar icepack, present especially difficult problems to those desiring to explore for and to develop the oil and gas reserves which are suspected and known to exist below these waters. These waters are often very shallow; in some areas 100 foot water depths are found 25 miles offshore. These waters are very remote from major centers of industry and commerce. They are covered by sheet ice through November to May and by floe ice in June through August, in a typical year. Temperature variations are extreme.

Offshore drilling and production platforms useful in waters of these depths have been developed for use in less hostile environments. The factors noted above, in combination, mean that existing platform structures either cannot be used at all in the Arctic, or they can be used only for short periods annually when waters are free of ice. Existing platforms, if used, must either be moved into, used, and moved out of the area from remote locations between May and November, or they must be stored during ice periods in protected local harbors which, because natural harbors are virtually nonexistent, must be constructed at great cost. For these reasons, existing offshore platforms of conventional design have not been and are not likely to be used in the Arctic.

In recognition of the special problems posed by the Arctic environment, various innovative approaches to offshore operations have been proposed or implemented. Approaches proposed include the use of a suitable platform and rig structure in a floating state during Arctic open water periods, use of the same structure on land during periods of ice formation and breakup, and use of the same structure on an ice sheet (with or without allowance for ice movement) during periods when the ice is of sufficient strength to support the structure; see U.S. Pat. No. 3,664,437. Other proposals seek to adapt platforms designed for warmer waters to Arctic conditions by the use of ice cutters and the like to the pylon of a monopod structure or the legs of a jack-up structure; see, for example, U.S. Pat. Nos. 3,669,052, 3,693,360, 3,696,624 and 3,871,184. Still other proposals involve the use of massive moored floating platforms of conical or bell-like shape capable of being heaved buoyantly to break and stand against encroaching ice. Yet another proposal involves a massive unitary fixed platform having a conical or hourglass configuration at and adjacent its waterline for causing encroaching ice to ride up on the structure and so break; see U.S. Pat. No. 3,972,199. Other proposals involve combinations and variations of the described proposals.

To date, none of the proposals reviewed above has been adopted in support of offshore operations in the Arctic. The reasons are varied. In some cases, the proposals are not suited to the shallow waters of interest. In other cases, the costs of construction, placement and operation of the proposed structures are unattractive. In some cases, the proposed structures are not sufficiently adaptable to varying sites of use to warrant the requisite investment.

The innovation which has been adopted to date in support of long-term offshore Arctic operations is the artificial island. Artificial islands are constructed in shallow water from rock, gravel and sand to provide an operations site capable of standing against extreme local environmental forces, notably those due to moving sheet or floe ice. While satisfactory and economically feasible in some circumstances, artificial islands have practical limitations on their utility. They are not movable. They are costly to construct; construction costs rise sharply with increasing water depth. Gravel and rock are not naturally readily available in many areas of interest; ready availability of adequate supplies of these materials directly affects the cost of constructing an artificial island. Proposals to overcome these limitations of artificial islands by the use of man-made year-round ice islands have their own limitations and have not been adopted.

It is thus seen that a need exists for a structural and procedural system which provides an Arctic offshore operations platform, such as an oil or gas drilling or production platform. Such a platform should be versatile, i.e., capable of use directly, or without substantial or costly modification, in waters of various depths. The platform should be readily movable to enable it to be used in different places over its useful life which should be long. The system should be adaptable to varying sea floor soils and soil conditions with minimal dredging or other preparation of the sea floor site. The platform must be capable of use year-round in the face of forces, notably ice-generated forces, tending to move the platform from its site of use. The platform should be capable of being readily and economically fabricated in existing construction facilities remote from the Arctic, and moved effectively and efficiently, without undue hazard, to Arctic waters where it can be readily installed without reliance on costly special equipment or procedures. The basic platform structure also should be compatible with a wide range of superstructure arrangements, thus enabling the platform to be used by different owners and operators who have their own preferences for functional equipment sets and layouts, and to be used for differing purposes such as exploration drilling, production drilling, and production from completed production wells, among other purposes. Further, the platform structure and its method of installation must be compatible with and protective of indigenous marine life and related environmental standards which are stringent in the Arctic.

A single-leg or monopod platform has been used for several years in Cook Inlet near Anchorage, Alaska in waters platform has a where floe ice or the like is present. That platform has a smooth-surfaced tubular pylon between the mat-type base and the elevated deck unit; subsea operations are conducted from the deck unit through the pylon and base. The Cook Inlet platform does not encounter thick ice sheets or pressure ridges as would be encountered in the margins of the Beaufort Sea offshore of Alaska and Canada. Also, the Cook Inlet structure is a permanently installed production platform designed, without jackup features and for construction on-site by assembly of pieces, for use in a specific location. The Cook Inlet structure uses multiple permanent piles, not mass, to hold it in place.

Other single-leg offshore platform structures of the jackup or similar type have also been proposed; see, for example, U.S. Pat. Nos. 3,996,754, 4,007,598 and 4,265,568. The single supporting legs or pylons of these structures are of the open trusswork type which cannot be used in the presence of ice because ice can become trapped in the trusswork, among other reasons.

These single-leg platform structures do not fill the need identified above.

SUMMARY OF THE INVENTION

This invention addresses the need identified above in a manner which meets the diverse practical, economic, functional, and environmental criteria and considerations which have been noted among others relevant. The present invention provides novel structural arrangements and procedural sequences which safely, efficiently, effectively and economically comport with the many competing, and often seemingly unreconcilable, factors pertinent to industrial operations and facilities in the Arctic and other areas of extreme conditions.

Briefly stated, in structural terms, the invention resides in a movable offshore platform structure of the gravity type. The structure is movable buoyantly to and from a site of use on a sea floor, the site being located in waters in a selected range of water depths. The platform structure comprises two principal elements, namely a mat base and a jackable deck unit. The base is adapted to engage the surface of a subsea soil layer and to be supported by the soil layer. A substantially cylindrical structural pylon has its lower end affixed to the base centrally of the base and extends to an upper end spaced from the base. The deck unit has an opening centrally through it through which the pylon passes. Securing means are releasably engageable between the deck unit and the pylon adjacent the pylon upper end for securing the deck unit to the pylon in spaced relation to the base. A plurality of jacking legs are carried by the deck unit at locations spaced from the deck unit central opening. Jacking means are cooperable between the legs and the deck unit. The jacking means are operable for jacking the deck unit relative to the base along the pylon in response to engagement of the leg lower ends with the base, and for jacking the legs to an elevated position at the deck unit.

The pylon has a smooth surface between the base and a location near the upper end of the pylon so that, when the platform structure is used in waters covered by sheet or floe ice, the pylon presents minimum resistance to the movement of ice past the pylon.

The pylon preferably is hollow and has an open upper end to define a passage through it and through the base so that desired subsea operations can be carried out through the passage from a suitable operations facility, such as a drilling rig, carried by the deck unit. Selected portions of the operations facility can be movably mounted on the deck unit for movement from a location to the side of the deck unit central opening to a location over the pylon when the deck unit is secured to the upper end of the pylon.

The base and the deck unit preferably are buoyant and floatable, and are ballastable with sea water.

The preferred procedure for installing the platform structure at a desired site of use includes moving the platform structure to near the site with the deck unit disposed on the base, with the pylon extending through the deck unit, and with the legs carried by the deck unit engaged at their lower ends with the base. Near the site, the platform structure is floated, and moved in a floating state to over the site. The base is ballasted to become negatively buoyant, and the legs are jacked down from the floating deck unit to controllably lower the base into supported engagement with the subsea soil layer at the site. The deck unit is then raised above the water surface by jacking it up the legs to the upper end of the pylon where it is secured to the pylon. The jacking legs are disengaged from the base and then jacked up away from the base to place their lower ends above the water surface at or near the deck unit.

If desired, an armor collar can be disposed around the pylon at the waterline of the installed platform structure. Preferably the armor collar is movable along the pylon and is securable to the pylon at the installed waterline. Where an armor collar is used, it is preferred that the deck unit central opening be sized so that the pylon and the collar can be received therein when the deck unit is disposed on the base, as in movement of the platform structure from a place of construction to near its site of use; in such instances, the pylon upper end preferably has enlarged cross-sectional area to cooperate closely with the deck unit central opening when the deck unit is raised to the upper end of the pylon.

DESCRIPTION OF THE DRAWINGS

The above-mentioned and other features, benefits and advantages of this invention are more fully set forth expressly or by clear implication in the following detailed description of presently preferred embodiments of the invention which provide the presently known best mode or modes for practicing the invention. The following description is presented with reference to the accompanying drawings wherein.

DESCRIPTION OF THE ILLUSTRATED EMBODIMENTS

The following detailed description of this invention is presented with reference to certain presently preferred platform structures embodying the invention. Certain dimensions and other physical and design properties of the platforms are mentioned by way of example to more fully inform the skilled reader about the invention, not by way of limitation or restriction. Platforms according to this invention can be constructed in various sizes, with various arrangements and features, and for different usage situations than those herein specifically mentioned. While Arctic usage of this invention is described in that context, it will be appreciated that platforms embodying this invention can be used to advantage in other areas of the world.

Figure 1:
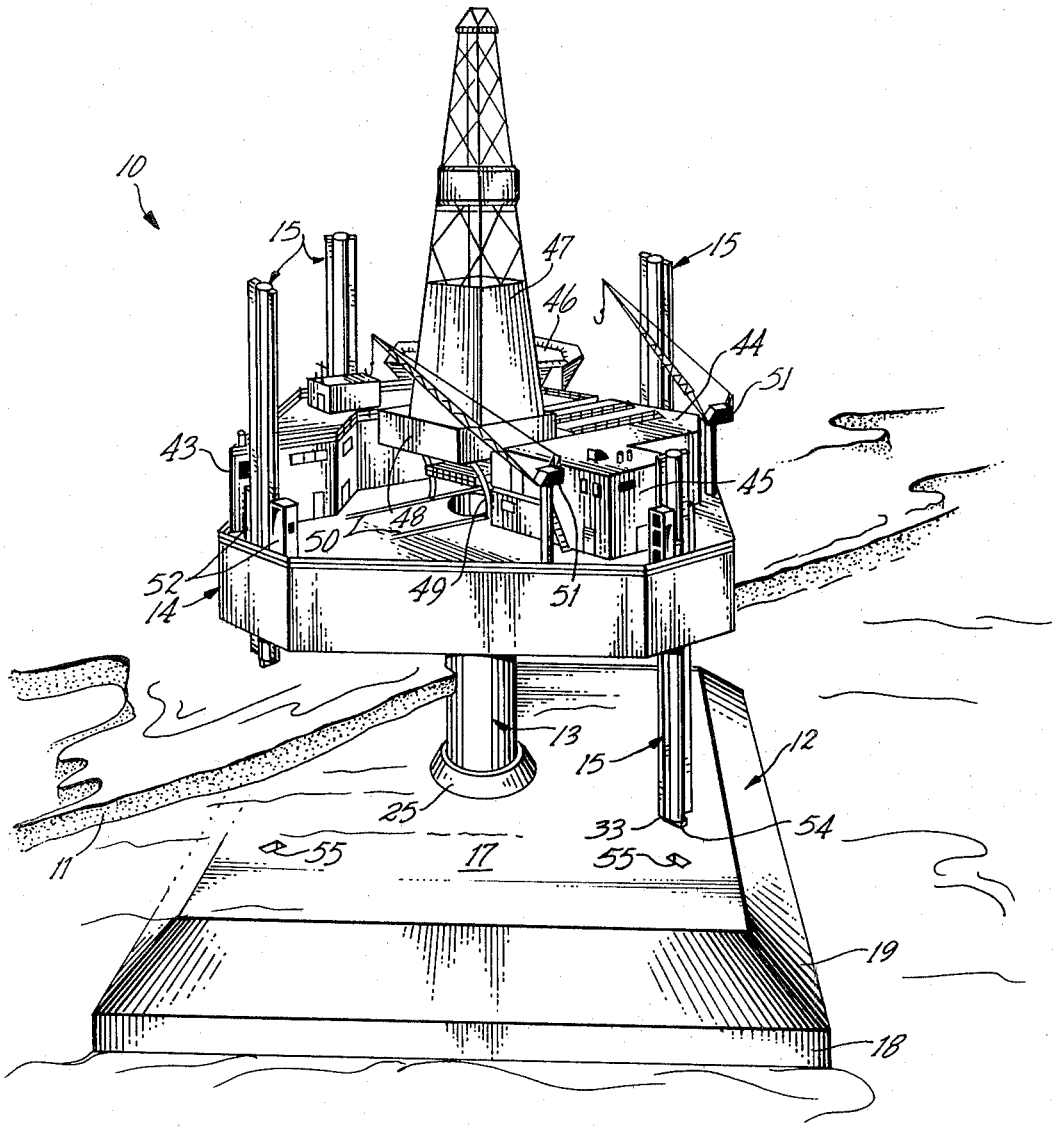
FIG. 1 is a perspective view of an offshore platform, equipped as a drilling platform, which constitutes that embodiment of the invention which is presently preferred and exemplifies the presently known best mode of practicing the invention.

A monopod, gravity-type jackup platform 10, well suited for use in waters covered periodically by a sheet of ice 11, is illustrated in the accompanying drawings of which FIG. 1 is a perspective view. The major structural aspects of platform 10 include a large mat-type base 12, a central pylon 13 affixed at its lower end to the base and extending normal to the base, a deck unit 14 movable along the pylon and securable to it above the base, and four tubular jacking legs 15 which are carried adjacent the corners of the deck unit.

Figure 3:
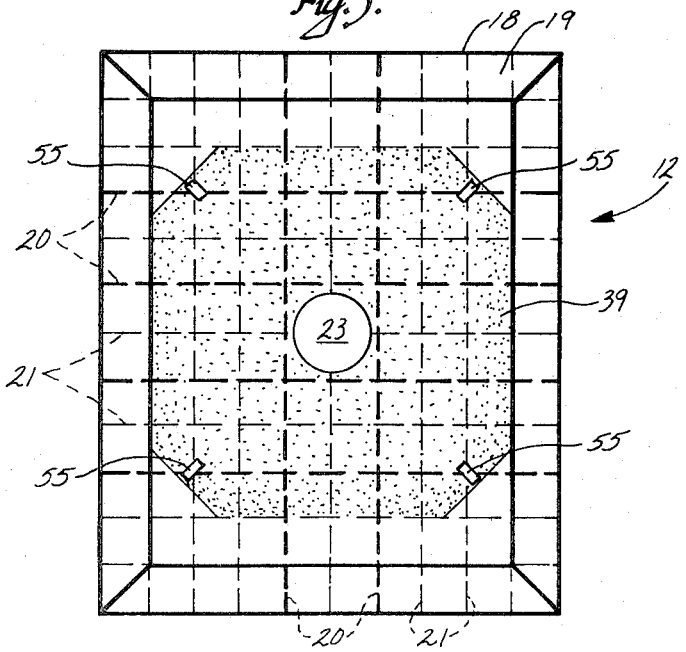
FIG. 3 is a plan view, with certain internal features shown in broken lines, of the base of the platform of FIG. 1.

Base 12, also shown in plan view in FIG. 3 with certain internal features depicted in broken lines, is a fabricated steel structure of substantial size. In the presently preferred embodiment of platform 10, the barge-like base is 25 feet high, 255 feet long and 212 feet wide. It has a generally flat bottom surface 16, a flat top surface 17, and side walls which are vertical at 18 for about 10 feet upwardly from the base bottom and which are sloped inwardly at 19 at a 35° angle to the horizontal to the base top surface. The base internal structure is defined by a plurality of bulkheads 20, web frames 21 and local stiffeners arranged to form a plurality of watertight compartments in the base.

Figure 8:
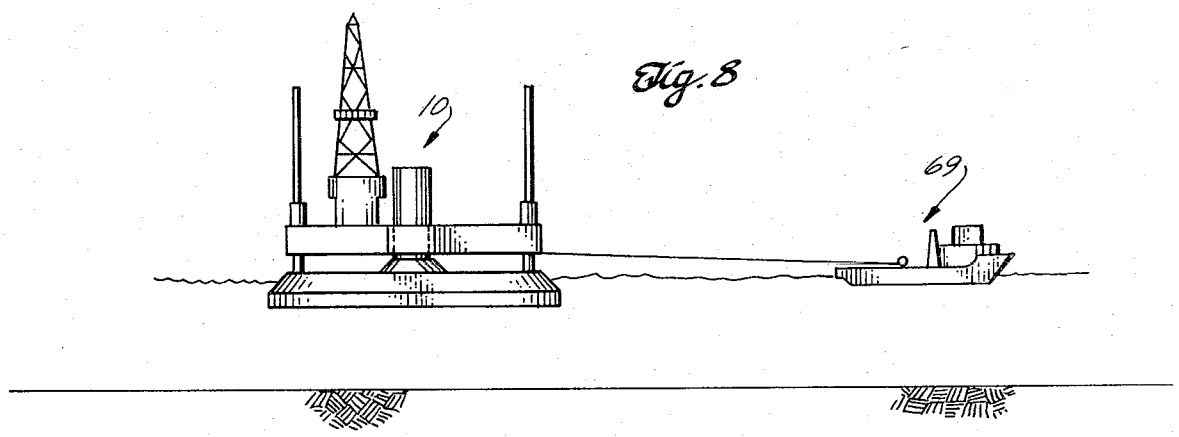
FIG. 8 shows a further step in the procedure for installing the platform.

The base is controllably ballastable with seawater between an unballasted buoyant state (see FIG. 8) and a ballasted state in which the base has substantial negative buoyancy. The base contains four piping systems (not shown) including ballast and vent piping for seawater ballasting, a saltwater feed system, treated sewage and bilge effluent piping, and a seawater jetting system by which water is jetted through nozzles in bottom surface 16 to assist in breaking the base free from a subsea soil stratum engaged by the base should the need arise in moving the platform from one use site to another. The ballast system is served by a submersible pump lowered through pylon 13 from its top.

The base skin plating varies in thickness from place to place on the base. Top plating is $1\frac{1}{2}$ in. thick around pylon 13, $1\frac{1}{4}$ in. thick around the margins of the base, and 1 in. thick in other areas. Bottom plating is 2 in. thick around opening 23 through the base, 1 in. thick around the margins, and 1 in. to $\frac{3}{4}$ in. thick in other areas. The base side plating is $1\frac{3}{4}$ in. thick to withstand local applied ice loads. Whereas the portions of platform 10 which are exposed to ambient (Arctic) air temperatures are fabricated of special cold steels, the base, interior and submerged structures are fabricated of ordinary steels.

In use of the platform, the base is heavily ballasted to provide the mass needed to enable the base to remain fixed on the subsea soil stratum at the use site. The ability of the base to remain stationary at the use site, in the face of substantial lateral ice loads, is a function of the platform mass and the coefficient of friction between the base and the subadjacent soil stratum. This coefficient is maximized by a waffle-like structure affixed to the base bottom surface. Such structure is defined by 3 in. by $\frac{1}{2}$ in. flatbars mounted on edge to base bottom surface 16 in a recurring pattern of 12 in. squares. Its presense insures an adequate interface between the base and the soil.

The base side and top surfaces, and the pylon surfaces, are coated with a low-friction polyurethane coating to provide a minimum coefficient of friction between ice and the base and to prevent adfreezing of ice to the structure. This feature cooperates with the slope of the base side walls in facilitating ice ride up onto the base and in reducing lateral ice loads on the base.

As shown in FIG. 3, base 12 is open at 23 in way of pylon 13 to define an extension through the base of a vertical passage formed by the pylon.

Pylon 13 preferably is circularly cylindrical. It is hollow and open at its upper and lower ends. In the presently preferred platform, the pylon is 30 feet in diameter and has a height of 90 feet. The lower end of the pylon is fixed to base 12 circumferentially about base opening 23. The pylon is perpendicular to the base. The pylon has a smooth closed outer surface 24. A transition collar structure 25 serves to structurally connect the pylon and the base adequately to insure that the pylon-to-base connection will withstand bending moments on the order of 785,000,000 foot-pounds during use of the platform. The pylon is structurally very strong. Its outer plating is 2 inches thick. 32 flanged stiffeners, each 2 feet deep, extend vertically along the inner surface of the pylon plating at regular intervals about its circumference. Flanged ring stiffeners, each 5 feet deep, are connected to the interior of the pylon plating and are spaced at 5 foot intervals along the height of the pylon. The pylon thus defines a 20 foot diameter clear passage along its length; base opening 23 provides an extension of this passage through the base. It is through this passage that subsea operations are conducted from deck unit 14 during use of platform 10. The pylon shell has sufficient local strength to withstand 1200 psi concentrated loads which can be imposed by multi-year ice bearing against the pylon.

If desired, the pylon can be tapered. If it is known that the platform will be used in areas where ice movement is exclusively or predominantly in either direction along a known line, the pylon can have an elliptical cross-section and be disposed with its major axis aligned with the line of ice movement.

Deck unit 14 is a positively buoyant principal component of platform 10. The deck unit is 26 feet high between its top and bottom surfaces 27 and 28, and in plan view has the geometry of a square with truncated or chamfered corners 29. The deck unit has a central octagonal opening 30 vertically through it and through which pylon 13 passes. Opening 30 cooperates loosely with the exterior of pylon 13 so that the platform can be moved up and down along the pylon. The basically square plan configuration of the deck unit is 170 feet between the opposite major side surfaces 31 of the platform and is 200 feet across between opposite corner surfaces 29.

Figure 5:
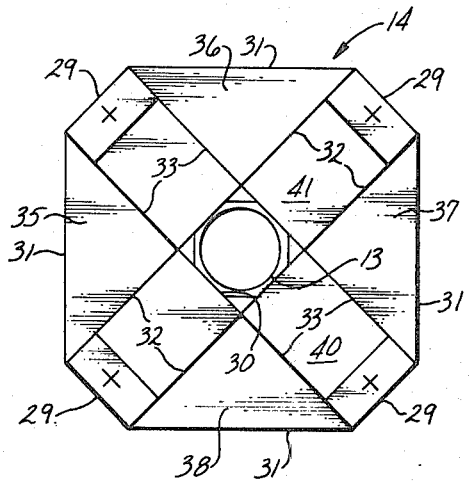
FIG. 5 is a simplified, essentially schematic, view of the internal structural arrangement and major compartmentation of the deck unit.

As shown in FIG. 5, two pairs of main structural bulkheads 32 and 33 extend diagonally of the deck between the opposite corners, bulkheads 32 being perpendicular to bulkheads 33. These bulkheads, together with the top and bottom plating of the deck unit, form two very heavy orthogonal box girders which support the deck unit and variable and drilling loads applied to it during use of the platform. These box girders automatically maintain the structural integrity of the deck unit when it is supported by jacking legs 15 (a sagging condition) or by pylon 13(a hogging condition). All major supplies of consumable liquids are contained within the box girders. A 5 foot deep double bottom 34 (see FIG. 2) is fitted throughout the four triangular machinery spaces 35 (see FIG. 5) formed by the intersection of the box girders. This arrangement results in an aggregate of 15,400 square feet of interior deck space. The triangular interior spaces of the deck unit are outfitted as the main power generation and distribution equipment room 35, an auxiliary machinery room 36, a mud pump room 37, and a mud mixing and storage room 38. These rooms have 21 feet of head room and are thus suitable for installation of intermediate or mezzanine decks if additional storage space is required. Double bottom 34, which extends below all of the machinery spaces, can be filled with saltwater ballast to maintain the desired gravity load of the platform on the subsea soil stratum as consumables aboard the deck unit are depleted.

The space 40 between bulkheads 33 at the ends of the bulkheads between rooms 37 and 38, and the space 41 between bulkheads 32 at the ends of those bulkheads between rooms 36 and 37 define four 900 barrel capacity drilling mud pits. Access archways are provided from mud pump room 37 to the mud pit areas. Mud mixing and storage room 38 is also accessible from mud pump 37 through mud pit space 40. Main generator room 35 and auxiliary machinery room 36 are also interconnected by a tunnel passageway through the box girder construction between these two machinery rooms.

Figure 4:
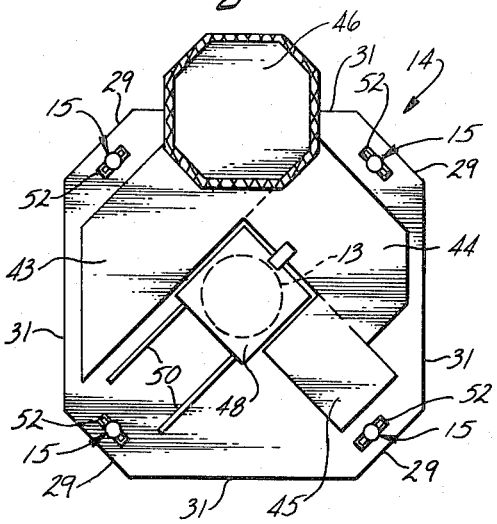
FIG. 4 is a plan view of the deck unit of the platform of FIG. 1.

The main or top deck of deck unit 14 is equipped with a three-story, eighty-man accommodations structure 43. Other structures on the main deck of the deck unit include a tubular goods storage and racker house for storage of drill pipe and casing required to support subsea drilling operations performed from the deck unit, and a drilling mud operations house 45. Structures 43, 44 and 45 are disposed to encompass three sides of opening 30 through the deck unit, as shown in the plan view of FIG. 4. A helicopter deck 46 is associated with the accommodations structure.

As shown best in FIG. 1, a drilling derrick 47 is erected on a drilling floor 48 which is supported on a derrick subbase structure 49. The derrick subbase structure is movably mounted on the main deck of the deck unit via a pair of rails 50 which are substantially aligned with box girder bulkheads 32 adjacent the fourth side of opening 30 through the deck unit. In this way, derrick 47 is carried on the deck unit for movement between a drilling position over opening 30 and a retracted position in which the derrick subbase is displaced laterally from opening 30 adequately to enable pylon 13 to project upwardly through the deck unit. The derrick subbase is moved along rails 50 by use of hydraulic equipment similar to that used on modern cantilever jackup drilling or workover platforms. The subbase is arranged so that storage, handling and maintenance of the drilling BOP assembly and drilling mud diverter is done in an environmentally protected area under derrick floor 48.

Figure 2:
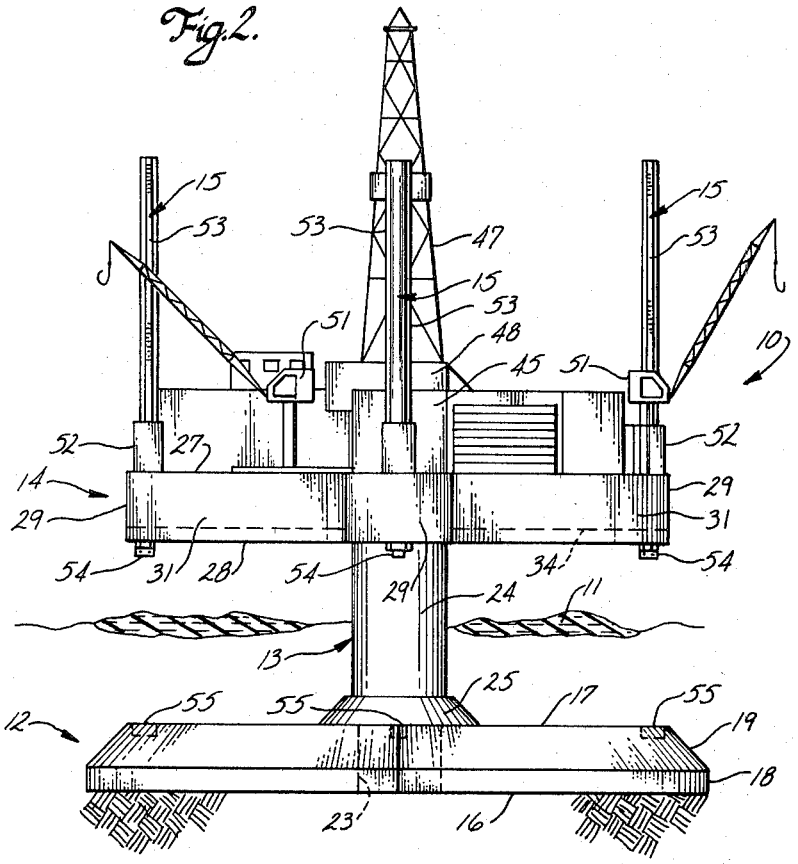
FIG. 2 is an elevation view of the platform of FIG. 1.

As shown in FIGS. 1 and 2, two 50 ton pedestal-mounted, remotely-operable revolver cranes 51 are mounted on the main deck of deck unit 14. The cranes are so located that jacking legs 15, when disposed in their elevated positions relative to the deck unit, do not interfere with operation of the cranes.

Pipe storage and racker house 44 encloses 2900 square feet of deck space. The house is a completely enclosed high-bay structure which features overhead pipe handling frames and hydraulic pipe handling equipment. A 40 foot long roll-up door is installed at one end of the house adjacent to an open pipe storage and crane landing area.

Jacking legs 15 are tubular in arrangement and carry dual-faced racks 53 along their length at diametrically opposed locations on the legs. Each leg is driven upwardly or downwardly relative to the deck unit by a pair of six-pinion jacking mechanisms 52, in which three jacking pinions cooperate with each one of the two rows of rack teeth on each of the dual-faced racks carried by the adjacent jacking leg. Tubular jacking legs 15, as contrasted with truss-type legs, require relatively little deck space at the extreme edges of the deck unit. 18,500 square feet of usable deck area is available on the main deck of the deck unit exclusive of the jacking leg stations and personnel quarters.

The lower end of each jacking leg carries a male component 54 of a leg latching structure which has a female counterpart 55 mounted in base 12 directly in line with each jacking leg. The location in the base of the several female components of the leg latching mechanisms is shown in FIG. 3. The latching mechanisms are remotely operable to cause the male and female components to be positively engaged with each other so that, as described more fully hereinafter, the base and pylon assembly can be lowered from the floating deck unit by controlled lowering of the jacking legs from the deck unit upon positioning of the platform above a subsea soil stratum with which the base is to be engaged.

Figure 6:
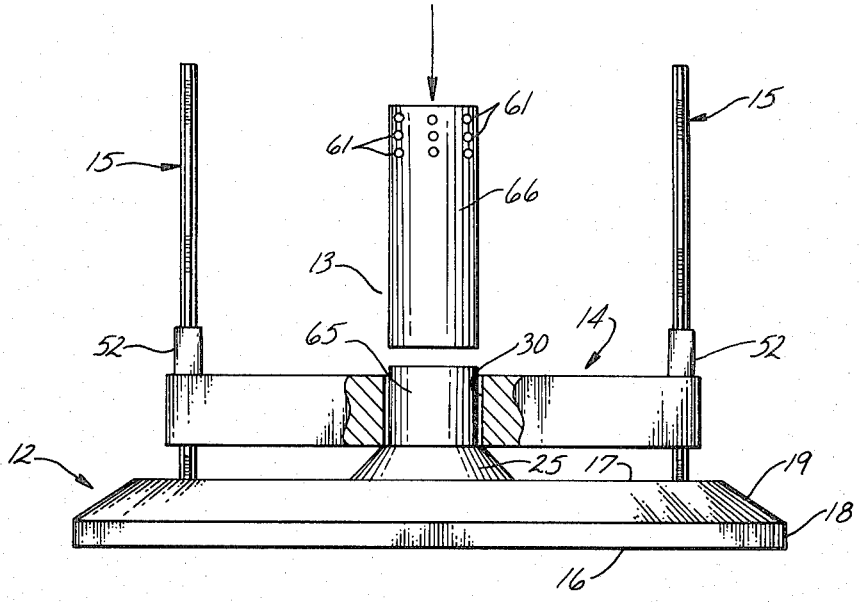
FIG. 6 is an elevation view of the platform of FIG. 1 showing an aspect of its preferred manner of construction.
Figure 15:
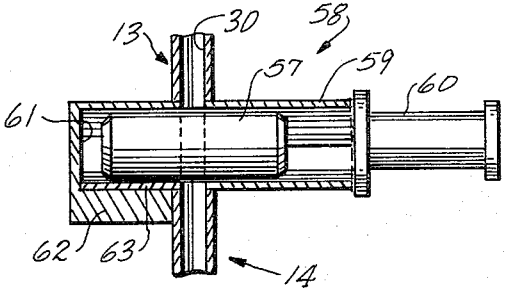
FIG. 15 is a fragmentary cross-sectional elevation view of one of the several identical mechanisms used in the platforms of FIGS. 1 and 12 to secure the deck-unit to the upper end of the pylon.
Figure 7:
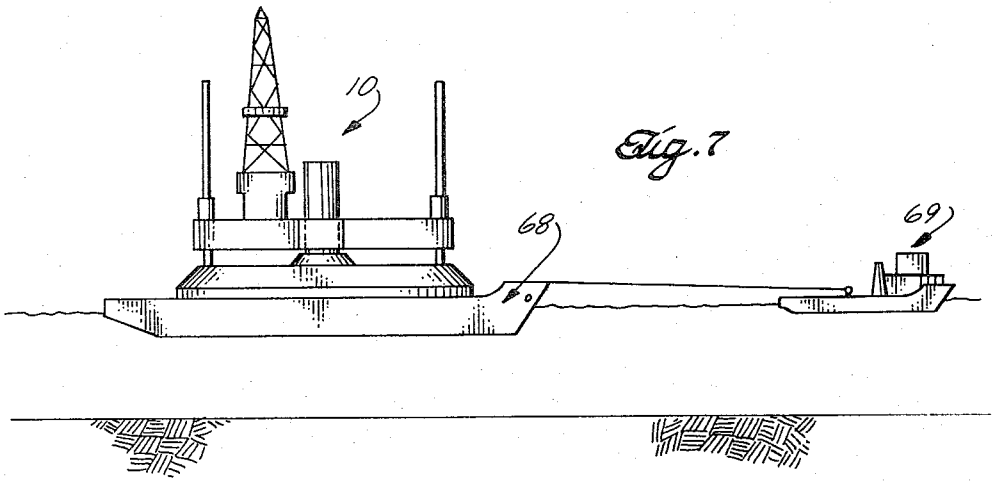
FIG. 7 is an elevation view of the platform of FIG. 1 showing the platform being towed on a barge as a preferred initial step in a procedure for installing the platform at a site of use.

The operating position of the deck unit is adjacent the upper end of pylon 13, i.e., with the upper end of the pylon either substantially flush with or slightly below the upper deck of the deck unit. The deck unit is secured to the upper end of the pylon via 24 retractable support pins 57 which are elements of 24 support pin assemblies 58, one of which is shown in FIG. 5. Support pins 57 are carried in housings 59 which are fixed to the deck unit and which open to central opening 30 through a corresponding one of the eight walls which define the perimeter of the octagonally shaped opening. Pins 57 are driven between retracted positions fully within housings 59 and extended positions (see FIG. 15) in which the pins extend from the housings. The pins are so driven by operation of hydraulic drive mechanisms 60. Each pin 57 is approximately 12 inches square in vertical cross-section and cooperates, when extended, in a recess 61 defined by a socket casting 62 which is securely affixed to pylon 13 so that the recess opens to the exterior of the pylon. Support pin assemblies 58 are disposed circumferentially of deck unit opening 30 in three layers of eight such assemblies each. The socket castings are similarly disposed in an arrangement of three layers of eight sockets each, as represented in FIG. 6. The lower surface of each pin receiving recess 61 is defined by a soft bronze shim 63. The shims assure that each pin cooperates with its socket in the same manner as all other pins cooperate with their sockets so that the load of the deck unit is distributed equally among all 24 pin and socket sets.

The position of deck unit 14 on pylon 13 is not adjustable along the height of the pylon. Rather, because of the geometry of the several support pin assemblies described above, the deck unit has a predetermined operating position at the upper end of the pylon. The deck unit is movable along the pylon between an at-rest transport position in which the deck unit rests upon base 12 and its operating position at the upper end of the pylon.

As noted above, pylon 13 is hollow and provides a 20 foot diameter clear passageway from its open upper end through the pylon and through base 12. This passageway is analogous to the moonpool of a drillship and provides the passageway through which subsea operations, such as exploration or production drilling operations, are performed from platform 10 into the geology below the platform during use of the platform.

FIG. 6 illustrates a recommended stage of and procedure for initial fabrication of platform 10. Because of the size of its principal components, platform 10 preferably is constructed in a location remote from the Arctic waters in which it has its preferred use. Base 12 and deck unit 14, both of which are buoyant and ballastable, are separately fabricated at a suitable site such as a shipyard. The base may be fabricated to define a pylon stub 65; the remainder of the pylon is fabricated as a subassembly 66. After the base has been fabricated and loaded with any permanent ballast desired, and following initial fabrication of the deck unit but before installation of the deck houses and other superstructures on the deck unit, the base is floated into a bay or other area of sheltered waters of suitable depth. The base is there controllably ballasted to a negatively buoyant state to settle to the bay bottom. The positively buoyant deck unit is then floated into position over the submerged base unit and positioned so that pylon stub 65 and deck unit opening 30 in the deck unit are substantially coaxial and so that jacking legs 15 are aligned with the female latching components 55 defined in the upper surface of the base. The jacking legs are lowered so that male and female latch components 54 and 55 engage. The base is then deballasted to become positively buoyant. Thereafter the deck unit is jacked down along jacking legs 15 to its lowermost position, either on or somewhat above the upper surface of the floating base. The base and deck unit are then moved back to the fabrication location where pylon subassembly 66 is lowered into registry with and secured to the upper end of pylon stub 65. The deck houses and superstructure of the deck unit are installed and final outfitting of the platform is completed. Suitable stores and other equipment, such as tubular goods for use in offshore drilling operations, may be loaded aboard the deck unit as part of the outfitting procedure. After completion of builder's and owner's trials and acceptance of the platform by the owner from the builder fabrication yard, the platform is ready for movement to Arctic waters.

Figures 9, 10, 11:
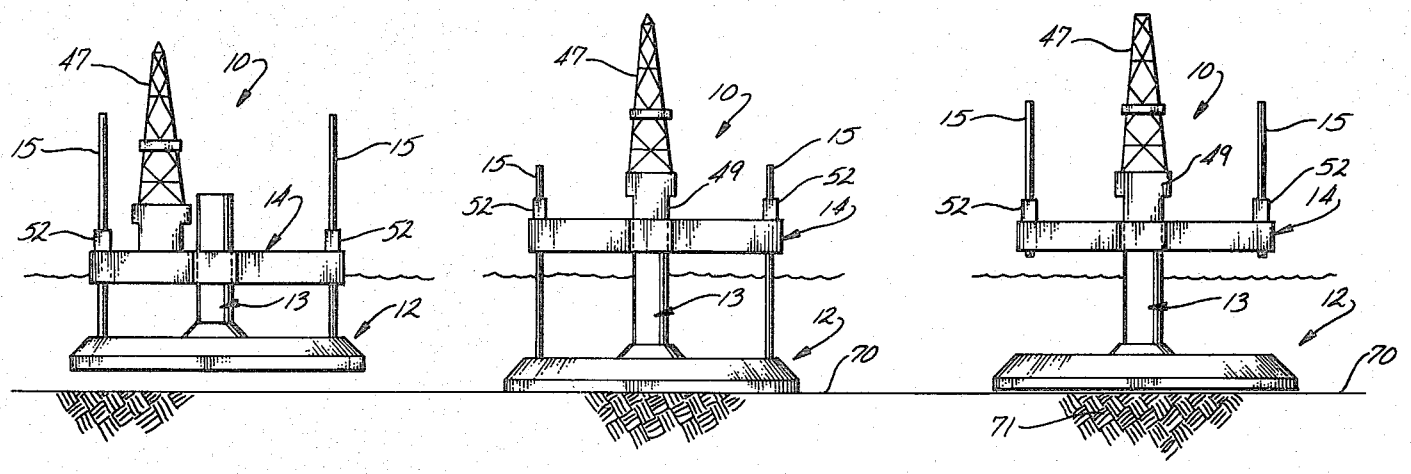
FIG. 9 shows a still further step in the platform installation procedure.
FIG. 10 shows still another step in the platform installation procedure.
FIG. 11 shows yet another step in the platform installation procedure.

The presently preferred procedure for transport of platform 10 to its site of use and for deployment and installation of the platform at such site is illustrated in the sequence of FIGS. 7 through 11. To prepare the platform for transit to the site, it is placed aboard a submersible barge 68. An ocean-going tug 69 is coupled to the barge for towing the barge with its load into Arctic waters during the short period in which waters along the desired route are ice free. (Submersible barge 68 is used for long tows; for short tows, as between different sites of of use in a common area, the platform can be towed while floating on either its deck unit or its base. Near the desired site of use (see FIG. 8), the submersible barge is ballasted down away from the platform which then becomes free floating on its base.) Tug 69 is connected to the floating platform for towing of the platform to over the intended site. At the site, as shown in FIG. 9, base 12 is ballasted to a condition of small negative buoyancy; at this time, the negative buoyancy of the base is less than the positive buoyancy afforded by deck unit 14. Accordingly, the overall platform is positively buoyant and floats on the deck unit. The base is then controllably lowered away from the deck unit by operation of jacking mechanisms 52 to lower jacking legs 15, which are latched to the base. The base is lowered from the deck unit until the base engages sea floor 70. The base is then fully ballasted to cause the base to become firmly engaged with the soil stratum 71 immediately below sea floor 70. Operation of jacking mechanisms 52 is continued without unlatching the jacking legs from the base, thereby to elevate the deck unit along pylon 13 until all of deck unit support pins 57 register with pylon recesses 61. The drive mechanisms in the several support pin assemblies are operated to advance the several support pins into secure mating engagement with recesses 61, thereby to secure the deck unit in its operating position at the upper end of pylon 13. Derrick subbase structure 49 is moved along rails 50 to position the derrick subbase over the top of the pylon where the subbase is secured, as shown in FIG. 10. Such movement of the derrick subbase, and of all structure carried by it, into a position over pylon 13 causes the center of gravity of the deck unit to be substantially aligned with the axis of the pylon, i.e., the eccentric loads on the deck unit are substantially reduced if not altogether eliminated. Thereafter, the jacking legs are unlatched from their engagement with base 12 and are jacked upwardly to their retracted positions shown in FIG. 11 in which the lower ends of the jacking legs are disposed substantially at or within the deck unit. The platform is then essentially ready for use as a mobile monopod gravity-mat jackup offshore drilling platform, subject only to the final loading of crew and remaining stores aboard the platform as from suitable service vessels or by helicopter.

The presently preferred embodiment of platform 10 according to the foregoing description has the following weights and capacities:

| | $10^6$ lbs. | $10^6$ lbs. |
|---|---|---|
| Deck Unit: | | |
| Steel Weight | 8.35 | |
| Outfit | 5.65 | |
| Variable load | 13.6 | |
| Total Elevated Load | 27.6 | 27.6 |
| Base and Pylon: | | |
| Steel Weight | 16.1 | |
| Permanent ballast (wet) | 12.4 | |
| Total Steel & Ballast | 28.5 | 28.5 |
| Total | | 56.1 (28,050 S.T.) |

From the data given in the foregoing table, it is seen that platform 10, by virtue of its own mass and the mass which can be added to it by ballast, stores and other equipment, has substantial immersed weight which, when applied over the 54,000 square feet of area of sea floor engaged by the landed base, provides sufficient mass (within acceptable soil load limits) to enable the platform to maintain its desired position on the sea floor even when subjected to substantial lateral loads applied to the pylon and base by ice and to the exposed portions of the pylon, the deck unit and its superstructure by winds.

Depending upon the extent to which the bare platform structure is loaded and outfitted following fabrication, the platform can have a draft of as little as 15 feet. This means that the platform can be moved to a site of use through waters having a depth as little as 15 feet. Fifteen foot water depth is the minimum operating water depth for the platform.

The minimum design operating water depth for the presently preferred platform described above is 35 feet. This means that if the platform is to be used at a site having a nominal 15 foot water depth, the site is prepared, in advance of installing the platform, by excavating a 350 foot diameter hole deep enough that the top of the base can be positioned 10 feet below the superadjacent water surface, i.e., 35 feet from the bottom of the excavation to the water surface. Base top surface 17 is positioned at least 10 feet below the water surface so that the expected ice sheet which can form in one year in Arctic waters of such depth will clear the base by 3 to 4 feet. In other words, platform 10 is positioned so that a one year ice sheet of approximately 7 feet thickness will normally have its lower surface 3 to 4 feet above the top of the installed base.

Where the base of the platform has a height of 25 feet and a pylon height of 90 feet, the platform can be used in water depths of 15 to 90 feet, thereby providing a minimum clearance of 30 feet between the water surface and the bottom of deck unit 14. By increasing the height of the pylon, platform 10 can be used in greater water depths.

Those familiar with drilling operations in the Beaufort Sea, offshore from Northern Alaska and northwestern Canada, will appreciate that the water depths mentioned above correspond to the margins of the Arctic Ocean beyond the southernmost limit of the polar ice pack. In these areas during the ice season, the water surface is covered predominantly by a one year ice sheet, i.e., that thickness of ice which can form in one year. In these areas, the one year ice sheet is 6 to 7 feet thick. However, in these areas floes of multi-year ice can be found as migrants from the polar ice pack. Also in these areas, pressure ridges are encountered as a result of shifting of one year ice due to various influences including wind and tide action. Pressure ridges can extend as much as 25 feet or so above the nominal one year ice sheet and for a substantial distance below such an ice sheet. Multi-year ice and pressure ridges have substantially greater effective ice strengths than one year ice sheets. The mass and strength of platform 10 is adequate to withstand the loads applied to it by one year ice sheets, multi-year ice floes, and pressure ridges engaging pylon 13 and base 12.

Platform 10 is designed to take advantage of the loads applied to it by a pressure ridge. The platform is configured so that a pressure ridge approaching pylon 13 is caused to ride up on base 12 so that part of the weight of the pressure ridge is borne by the base. This increases the effective load of the base on the soil stratum 71 and thus increases the effective load of the platform on the soil stratum to further enhance the station-keeping ability of the platform in the face of applied ice loads. Workers skilled in the art will appreciate, however, that, in extreme cases, conventional ice defense practices can be used to keep the lateral loads applied to the platform by ice within acceptable limits.

The use of jacking mechanisms cooperating between deck unit 14 and pylon 13 is intentionally avoided in platform 10. Use of jacking legs 15 and jacking mechanisms 52 to move the deck unit upwardly and downwardly along the pylon relative to base 12 enables the pylon to be defined with a smooth exterior surface. Such would not be the case if the pylon were fitted with either projecting or recessed jacking racks. The presence of projecting or recessed jacking rack features on the surface of the pylon would serve as ice catchers to substantially increase the force applied to the pylon by ice tending to move past the pylon, thereby substantially increasing the lateral load on the pylon and the moments applied to the pylon and its connection to the base. If the pylon were used as a part of the deck unit jacking mechanism, it would be necessary to substantially increase its diameter to enable it to withstand the increased ice loads to which it would be subject. Increasing the pylon diameter, however, makes the pylon appear more as a wall to adjacent ice. Pylon 13, however, is of rather small diameter and so presents minimal surface area to an advancing ice sheet. The pylon, due to its small diameter, acts as an indenter upon advancing ice to stress and crack the ice and so make it easier for the ice to move around and past the pylon.

Another advantage of jacking legs 15 is that the machinery required for their movement upwardly and downwardly relative to the deck unit is more easily accommodated if mounted near the corners of the deck unit, rather than congesting the area directly under the rig floor where space is at a premium for support of the intended operations to be performed from the platform. Moreover, the use of outboard jacking legs 15 makes it much easier to keep the platform level as it is moved upwardly and downwardly along the pylon. Furthermore, by avoiding use of pylon 13 as a part of the deck unit jacking mechanism, the pylon can be fabricated using normal fabrication techniques, and reliance upon close tolerances can be avoided, thereby enhancing the economics of the platform. The use of outboard jacking legs also makes it much easier to accommodate the presence of eccentric loads on the deck unit as the deck unit is being moved upwardly and downwardly along the pylon. This means that the platform can be constructed and outfitted with regard to its intended use rather than with regard to limitations imposed by concern over eccentric loads during jacking procedures.

Figures 12, 13, 14:
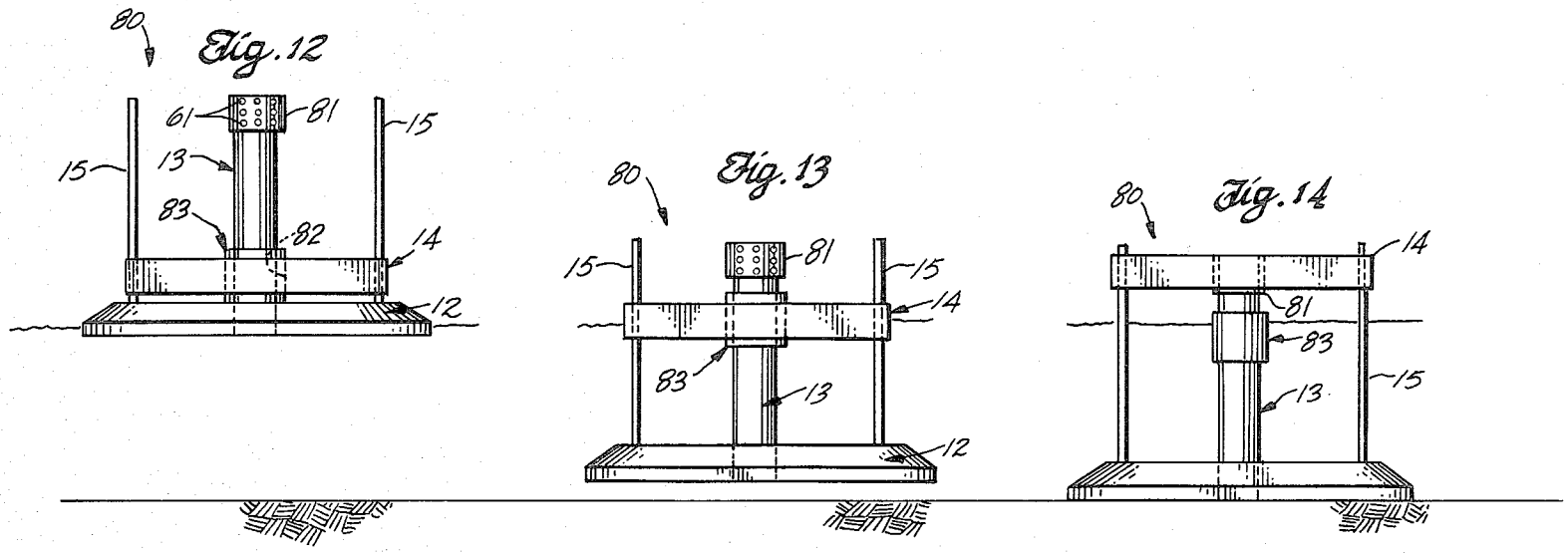
FIG. 12 is an elevation view of another platform according to this invention at an early step in the process of installing it on a sea floor.
FIG. 13 shows the platform of FIG. 12 in a further step of its installation process.
FIG. 14 shows the platform of FIG. 12 in a still further step of its installation process.

In certain arctic waters, localized ice loads applied to the pylon of a monopod jackup platform according to this invention may be of such nature as to exceed the local strength of the pylon if the pylon is constructed according to the foregoing descriptions. One advantage of a platform according to this invention is that it can be used repeatedly at water depths which vary from site to site within a specified range of water depths, say, 15 to 90 feet. Fabrication of the pylon to have increased local strength over at least a substantial portion of its height, consistent with such range of water depths would result in the pylon being made overly heavy for any particular usage situation. FIGS. 12, 13 and 14 illustrate the essentials of the structure and installation procedure pertinent to another platform 80 according to this invention, which platform addresses this situation and the concerns posed by it.

Platform 80 differs from platform 10 principally in three respects, namely, (1) the upper end of pylon 13 has an enlarged diameter head 81 in which deck unit support pin recesses 61 are defined, (2) deck unit 14 has an enlarged central aperture 82 which is preferably of octagonal configuration and is sized to cooperate with pylon head 81 in the same manner in which deck unit opening 30 of platform 10 cooperates with the upper end of the pylon of that platform, and, (3) a movable ice armor collar 83 is disposed around pylon 13 for movement along the pylon between base 12 and pylon head 81 and for affixation to the pylon at any desired location within its range of movement.

The outer diameter of collar 83 is less than the clear effective diameter of deck unit opening 82. Collar 83 has a smooth, circularly cylindrical outer surface. Collar 83 is, in effect, a movable pylon armor belt which can be raised upwardly from base 12 with deck unit 14 as the deck unit is elevated relative to the base in the course of installing platform 80 at an intended site of use; see FIG. 13. The collar outer diameter is less than or equal to the diameter of pylon head 81.

Consistent with the previously described platform installation procedure, collar 83 is secured to deck unit 14 to permit the collar to move with the deck unit upwardly along the pylon as the negatively buoyant base is lowered from the positively buoyant deck unit to the sea floor at the site of use. At the time the base engages subsea soil stratum 70, the deck unit will have a position on the pylon corresponding to the waterline of the platform as installed. Before any further movement of the deck unit upwardly along the pylon is produced, collar 83 is suitably secured to the pylon, such as by the use of pin-and-socket mechanisms cooperating between the collar and the pylon similar to the deck unit pin-and-socket support assemblies illustrated in FIG. 15; in this instance, the presence of small recesses in the exterior surface of the pylon throughout a selected portion of the height of the pylon is not troublesome because those sockets which would provide an impediment to movement of ice past the pylon are those sockets which are located near the waterline of the platform where the sockets will be masked by the presence of the armor collar on the pylon. After collar 83 has been securely connected to the pylon, the connection between the collar and deck unit 14 is released. The deck unit is then jacked up on legs 15 for mating of deck unit opening 82 with pylon head 81, at which time deck unit support pins 57 are advanced into engagement with their cooperating recesses 61 which are defined in the pylon head. In this way, the deck unit is secured to the pylon of platform 80 in essentially the same way as the deck unit is secured to the upper end of the pylon of platform 10.

The use of ice armor collar 83 in platform 80 allows pylon 13 to be designed primarily with reference to the bending and shear loads which it is required to bear and without reference to considerations of local ice loads.

A platform according to this invention has several significant features and advantages. The jackup nature of the platform affords flexibility in use over a wide range of water depths. Because it relies upon gravity loads for station-keeping, it is structurally simple. The monopod (single support leg) design results in a platform which is as passive as possible. Because the platform is mobile and reuseable, and because all necessary operational systems are incorporated in construction, it provides a low cost per well over the long life of the platform. It can be used with weak soils in view of its large footprint area. The monopod design minimizes ice forces on the platform and has the advantage that some ice forces are applied to enhance station-keeping ability. The large storage capacities of the platform result in the platform and its personnel having reduced dependence upon support vessels. The platform uses only seawater ballast to supplement on-board permanent ballast in the base. The platform is inherently light when unballasted, and so has minimum draft for use in shallow water. Preliminary usage site preparation is minimal, if required.

The foregoing description has been presented with reference to certain dimensions, weights and relationships pertinent to presently preferred embodiments of the invention. This description has been presented by way of example and illustration of the principles, features and relationships which characterize this invention, rather than by way of limitation or as an exhaustive catalog of all forms of structural arrangements and procedural sequences which may embody this invention. Workers skilled in the art to which this invention pertains will realize readily that modifications, alterations and variations in the structures and procedures described above may be practiced without departing from the scope of this invention. Accordingly, the foregoing description is to be read as an enabling foundation supportive of the following claims which are to be given their fullest fair scope and content consistent with this description and with the true scope and content of the relevant art and technology.

I claim:

1. An offshore platform structure comprising a mat base adapted to engage the surface of and be supported by a subsea soil layer, a closed-surface pylon affixed at a lower end thereof to the base centrally thereof and extending to an upper end spaced from the base, a jackable deck unit having therethrough a central opening for passage of the pylon therethrough, securing means releasably engageable between the deck unit and the pylon adjacent the upper end of the pylon for securing the deck unit to the pylon in spaced relation to the base, a plurality of jacking legs carried by the deck unit in spaced relation to the central opening, and jacking means cooperable between the legs and the deck unit and operable for jacking the deck unit relative to the base along the pylon in response to engagement of the leg lower ends with the base and for jacking the legs to an elevated position at the deck unit.

2. A platform according to claim 1 wherein the pylon is hollow and defines a portion of an open-ended passage through the pylon and the base.

3. A platform according to claim 2 including a derrick mounted on the deck unit for movement between a first position over the deck unit opening and a second position in which the derrick is spaced laterally from the central opening.

4. A platform according to claim 1 wherein the deck unit is of rectangular planform configuration, and the jacking legs are located adjacent the deck unit corners.

5. A platform according to claim 4 wherein the deck unit is arranged to define a substantial box girder arrangement extending between each two diagonally opposite corners of the deck unit.

6. A platform according to claim 1 wherein the base is controllably ballastable with seawater between a state of substantial positive buoyancy adequate to float the platform and a state of substantial negative buoyancy.

7. A platform according to claim 1 wherein the deck unit is controllably ballastable between a state of positive buoyancy in which the deck unit has sufficient buoyancy to support itself with the base slightly negatively buoyant, and a ballasted state when the deck unit is secured to the pylon.

8. A platform according to claim 1 wherein the base has top and bottom surfaces and side surfaces between the top and bottom surfaces, and the side surfaces slope inwardly to the top surface.

9. A platform according to claim 8 including a low friction coating on the pylon and the base top and sloping surfaces.

10. A platform according to claim 1 including selectively operable latch means cooperable between the lower ends of the jacking legs and the base operable for securely yet releasably connecting the leg ends to the base.

11. A platform according to claim 1 wherein the jacking means are operable for forcibly moving the legs both upwardly and downwardly relative the the deck unit.

12. A platform according to claim 1 wherein the jacking legs are tubular.

13. A platform according to claim 1 wherein the closed exterior surface of the pylon is smooth along the height of the pylon from the base to adjacent the upper end of the pylon.

14. A platform according to claim 1 wherein the pylon is circularly cylindrical.

15. A platform according to claim 1 wherein the pylon has an upper head portion larger in horizontal dimensions than the pylon adjacently therebelow and configured to register in the deck unit central opening, an annular collar of selected height movable along at least a selected portion of the pylon between the head portion and the base, the collar being configured and sized to fit within the deck unit central opening, means cooperating between the pylon and the collar and operable for securing the collar to the pylon in said selected portion of the pylon, and means for moving the collar along the pylon.

16. A platform according to claim 15 wherein the means for moving the collar along the pylon includes means cooperating between the collar and the deck unit.

17. A platform according to claim 15 wherein the means for securing the collar to the pylon includes retractible pin means.

18. A platform according to claim 1 wherein the securing means includes retractible pin means.

19. A method for installing an offshore drilling platform having structure comprising:

(a) a buoyant base ballastable to a state of substantial negative buoyancy, (b) a pylon secured at a lower end thereof to a central portion of the base and extending upwardly from the base, (c) a buoyant and ballastable deck unit located above the base and having a central opening therethrough and through which the pylon is movable, and (d) a plurality of vertical jacking legs carried by the deck unit in substantial spaced relation to the central opening and drivable from the deck upwardly and downwardly relative to the deck unit, the method comprising the steps of:

(1) floating the platform on the base to a site of use in waters having a depth at the site of at least a selected amount less than the height of the base and the pylon, (2) connecting the lower ends of the jacking legs to the base and locking the legs to the deck unit, (3) ballasting the base to a state of slight negative buoyancy and floating the platform on the deck unit, (4) lowering the base from the deck unit via the jacking legs into engagement of the base with a soil stratum below the deck unit, (5) raising the deck unit above the water surface along the pylon on the jacking legs into registry of the deck unit central opening with the upper end of the pylon, (6) securing the deck unit to the upper end of the pylon, (7) disconnecting the jacking legs from the base, and (8) raising the jacking legs to a retracted position at the deck unit.

20. Minerals, including hydrocarbons, both raw and refined, produced from a subsea deposit by use of a platform structure according to claim 1.

21. Minerals, including hydrocarbons, both raw and refined, produced from a subsea deposit by use of a platform installed above the deposit by use of the method according to claim 19.

* * * * *